US005146885A

United States Patent [19]

Fukuma et al.

[11] Patent Number: 5,146,885

[45] Date of Patent: Sep. 15, 1992

[54] AIR-FUEL RATIO CONTROL DEVICE FOR AN ENGINE

[75] Inventors: Takao Fukuma; Keisuke Tsukamoto; Toshio Takaoka; Hirofumi Yamasaki, all of Toyota, Japan

[73] Assignee: Toyota Jidosha Kabushiki Kaisha, Toyota, Japan

[21] Appl. No.: 785,166

[22] Filed: Oct. 31, 1991

Related U.S. Application Data

[63] Continuation of Ser. No. 647,497, Jan. 29, 1991, abandoned.

[30] Foreign Application Priority Data

Jan. 31, 1990 [JP] Japan ..... 2-18977

[51] Int. Cl.[5] ..... F02D 41/04; F02D 41/10

[52] U.S. Cl. ..... 123/308; 123/422; 123/478; 123/492

[58] Field of Search ..... 123/308, 399, 416, 417, 123/422, 423, 478, 489, 492, 493

[56] References Cited

U.S. PATENT DOCUMENTS 4,483,301 11/1984 Yamada et al. ..... 123/478 X
4,528,956 7/1985 Ogata et al. ..... 123/478 X
4,592,315 1/1986 Kobayashi et al. ..... 123/188 M
4,594,984 6/1986 Raff et al. ..... 123/481 X
4,633,841 1/1987 Matsuura et al. ..... 123/478 X
4,651,700 3/1987 Kobayashi et al. ..... 123/489
4,759,329 7/1988 Nobuo et al. ..... 123/478 X
4,936,278 6/1990 Umeda ..... 123/489
5,014,668 5/1991 Klenk et al. ..... 123/489 X

FOREIGN PATENT DOCUMENTS 58-065946 4/1983 Japan .
59-226255 12/1984 Japan .
60-30443 2/1985 Japan .
61-187545 8/1986 Japan .
62-253944 11/1987 Japan .

*Primary Examiner*—Tony M. Argenbright
*Attorney, Agent, or Firm*—Kenyon & Kenyon

[57] ABSTRACT

An air-fuel ratio control device for an engine, by which the air-fuel ratio of the air-fuel mixture supplied to the engine is changed. The device set the air-fuel ratio to a lean mixture when the engine load is lower than a set load value and predetermined set speed, and when the engine load become higher than the set load value, or the engine speed exceeds the set speed, the device switches the air-fuel ratio from a lean mixture to a rich mixture to obtain higher engine output. The set load value is varied in accordance with the engine speed such that it is reduced as the engine speed is increased.

19 Claims, 8 Drawing Sheets

| Fig. 1A |
| --- |
| Fig. 1B |

AIR-FUEL RATIO CONTROL DEVICE FOR AN ENGINE

This application is a continuation of application Ser. No. 07/647,497, filed on Jan. 29, 1991, now abandoned.

BACKGROUND OF THE INVENTION

1. Field of the Invention

The present invention relates to an air-fuel control device for an engine which can be operated on an air-fuel mixture having either a rich or a lean air-fuel ratio.

2. Description of the Related Art

Engines operated on a lean air-fuel mixture having an air-fuel ratio higher than a stoichiometric ratio in the main operating range are known as lean burn engines. These lean burn engines are usually operated on a lean air-fuel mixture and are switched to operation on a rich air-fuel mixture when an acceleration or a high load operation is required.

Some lean burn engines are also equipped with swirl control valves, to thereby obtain a better combustion of the lean air-fuel mixture, and usually, these engines are provided with two inlet air passages for each engine cylinder; one leading to a helical inlet port of the cylinder, which generates a swirl of the inlet air therethrough in the cylinder, and the other leading to a conventional low pressure drop straight type inlet port.

The swirl control valve is provided in the inlet air passage of the straight port, for blocking the air passage in accordance with the load condition of the engine. For example, when the engine is operated at a low speed and low load, the swirl control valve is closed to block the inlet air passage to the straight port, and the amount of fuel injected and the ignition timing are adjusted to obtain a lean air-fuel mixture operation. When the air passage to the straight port is blocked, all of the inlet air to the engine flows into the engine cylinder through the swirl inlet port, and thus a strong swirl of an air-fuel mixture is generated within the cylinder, and therefore, a stable combustion can be obtained with a lean air-fuel mixture.

When the engine is operated at a high load, high speed condition, the swirl control valve is opened to allow inlet air into the cylinder through the low pressure drop straight port, and the amount of fuel injected and the ignition timing are adjusted to obtain a rich (or stoichiometric) air-fuel ratio mixture. Accordingly, the engine output is increased due to the increased inlet air flow and richer air-fuel ratio.

This type of the engine is disclosed, for example, by Japanese Unexamined Patent Publication No. 60-237140. In this engine, the switching of the swirl control valve and the air-fuel ratio is initiated by the degree of opening of the throttle valve; i.e., when the degree of opening of the throttle valve becomes larger than a predetermined value, the swirl control valve is opened and the air-fuel ratio is adjusted to obtain a rich mixture.

Typically, the operation of the swirl control valve and switching of air-fuel ratio are controlled by parameters representing an engine load (such as the degree of opening of the throttle valve) or engine speed, or both. FIG. 7 is a diagram indicating a typical operation mode of the engine. As shown in FIG. 7, the engine operation mode is switched to a rich mixture mode in which the swirl control valve is opened, and the amount of the fuel injected and the ignition timing are adjusted to a rich air-fuel mixture operation when the degree of opening of the throttle valve SV becomes larger than a predetermined value $SV_0$, or the engine speed NE becomes higher than a predetermined value $NE_0$. Due to the current demands for a low fuel consumption, it is desired to broaden the range of a lean air-fuel mixture, as shown in the typical example in FIG. 7, in which the predetermined value $SV_0$ for the degree of opening of the throttle valve is set at 60–80%, and the predetermined value $NE_0$ for the engine speed is set at about 4000 rpm.

In the lean mixture operation in which the swirl control valve is closed, however, the volume of the inlet air flow is much lower than in a rich mixture operation, because all of the inlet air flows into the cylinder through the swirl inlet port, and thus a higher pressure loss occurs than in the straight type port.

Also the engine output torque per unit inlet air volume is lowered due to the lean air-fuel ratio of the mixture, and accordingly, a torque generated by the engine becomes low during the lean mixture operation. Therefore, to obtain the same rate of acceleration, the driver must depress the accelerator pedal by a larger amount during the lean mixture operation than during a rich mixture operation. Namely, if an acceleration is required when the engine speed is close to $NE_0$ (points A and B in FIG. 7), the amount of depression of the accelerator pedal is larger at point A ($\Delta SV_1$ in FIG. 7) than at point B ($\Delta SV_2$ in FIG. 7), even if the loads and the speeds of the engine before the start of the acceleration are almost the same at points A and B. This difference in the operation is confusing to the driver of the vehicle, and further, since an acceleration is frequently required in the middle engine speed range, i.e. close to $NE_0$, the frequent occurrence of this difference in operation of the accelerator pedal causes the driver to become uneasy.

To solve this problem, it is possible to set the $SV_0$ and $NE_0$ lower values, so that the engine is always operated on the rich mixture in the operation range in which acceleration is frequently required. But this broadens the range of the rich mixture operation, and thus the fuel consumption of the engine is worsened because the engine is operated more frequently in the rich mixture mode.

SUMMARY OF THE INVENTION

An object of the present invention is to solve the aforementioned problem by providing an air-fuel ratio control device which ensures a good acceleration in a speed range near to the upper speed limit of the lean mixture operation mode range, without a worsening of the fuel consumption.

According to the present invention, there is provided an air-fuel ratio control device for an engine comprising: means for detecting a load of the engine; means for detecting a speed of the engine; operation mode selecting means for selecting operation modes of said engine, the operation mode selecting means selecting a rich mixture operation mode in which the engine is operated on a rich air-fuel mixture having an air-fuel ratio lower than or equal to a stoichiometric ratio when the engine load is higher than a set load value, and the operation mode selecting means selecting a lean mixture operation mode in which the engine is operated on a lean air-fuel mixture having an air-fuel ratio higher than the stoichiometric ratio when the engine load is lower than or equal to the set load value; air-fuel ratio setting means for adjusting the air-fuel ratio in accordance with the operation mode selected by the operation mode selecting means; and load value setting means for setting the set value of the engine load, the load value setting means setting the set load value in accordance with the engine speed so that the set value is lowered as the engine speed is increased.

The present invention will be better understood from the description of a preferred embodiment of the invention set forth below, together with the accompanying drawings.

DESCRIPTION OF A PREFERRED EMBODIMENT

Figures 1, 1A:
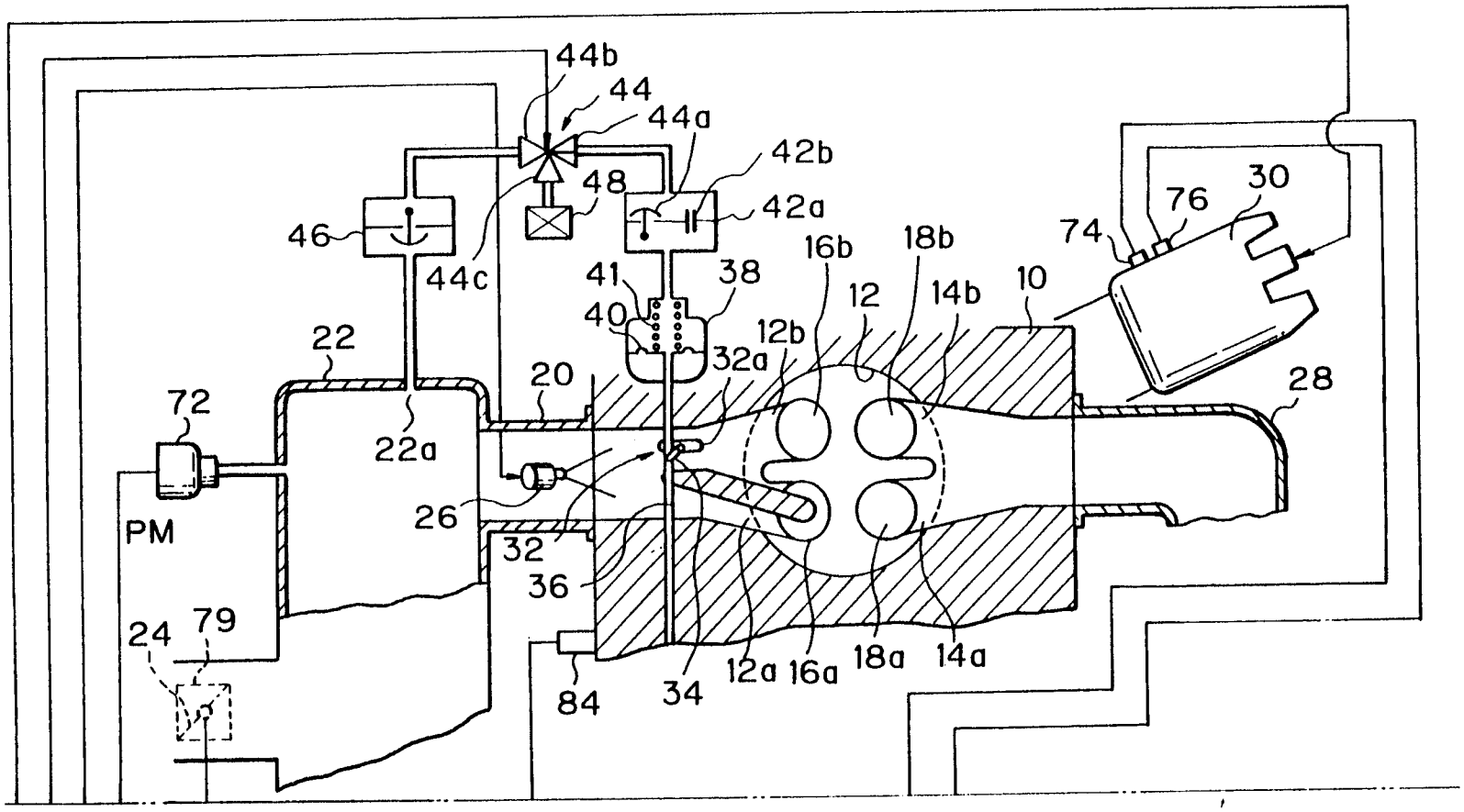
FIGS. 1, 1A and 1B are a schematically illustrated view of an engine.
Figure 1B:
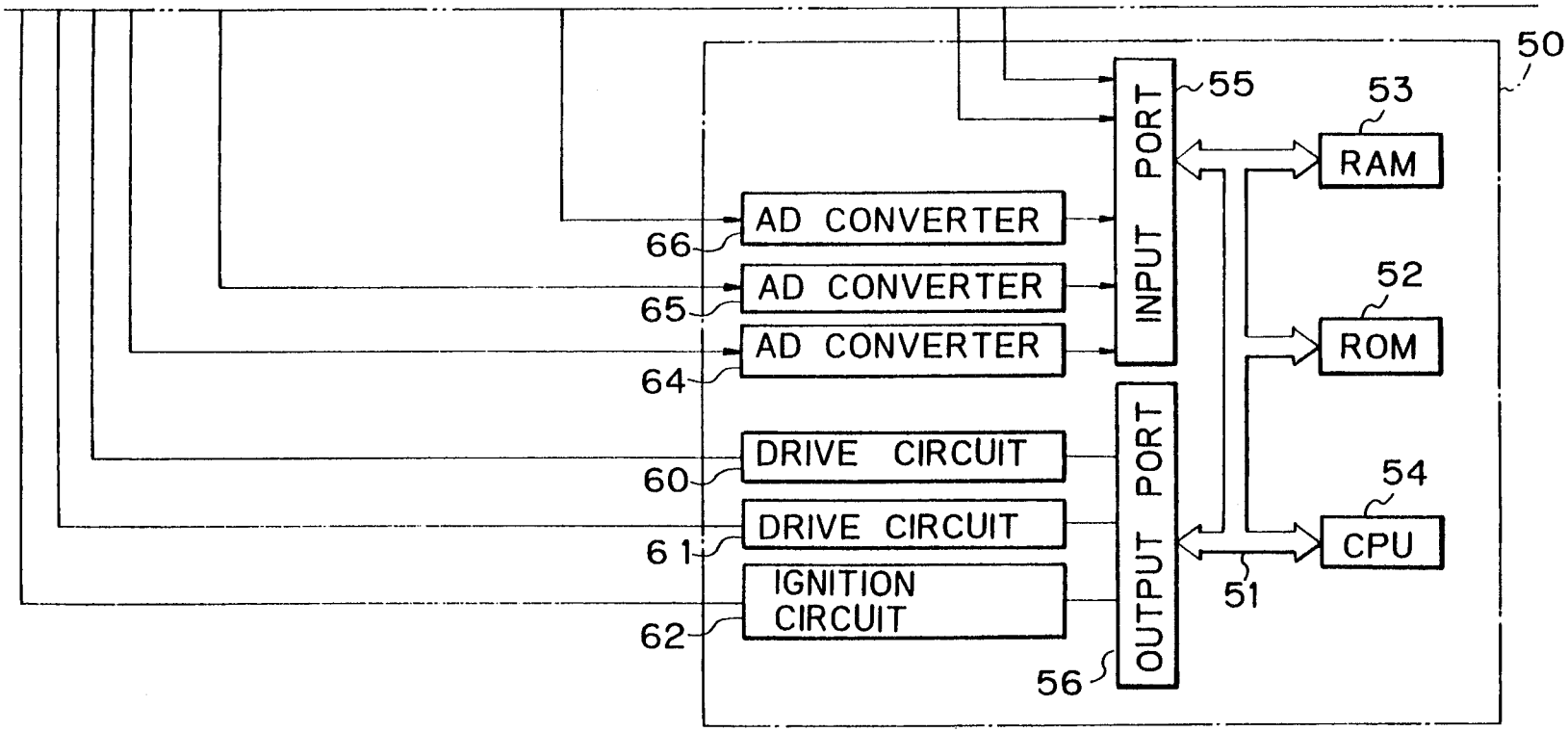

FIG. 1 illustrates an embodiment of the air-fuel ratio control device according to the present invention.

Referring to FIG. 1 reference numeral 10 represents a cylinder block of an engine, and 12 is a cylinder bore. As shown in the figure, each cylinder of the engine is provided with two intake ports 12*a*, 12*b* and two exhaust ports 14*a*, 14*b*, and inlet valves 16*a*, 16*b* and exhaust valves 18*a*, 18*b* are provided at the respective ports, 12*a*, 12*b* and 14*a*, 14*b*.

The first inlet port 12*a* is formed as a helical port which deflects the inlet air flow to thereby generate a swirl in the cylinder. The second inlet port 12*b* is formed as a conventional straight type inlet port. The inlet ports 12*a* and 12*b* are connected to a surge tank 22 and a throttle valve 24 via an intake air passage 20, and a fuel injector 26 is mounted on the intake air passage 20 near each cylinder. The exhaust ports 14*a* and 14*b* are connected to an exhaust manifold 28.

Reference numeral 30 represents a distributor which supplies high voltage electricity to spark plugs (not shown) at the respective cylinders.

Each straight type inlet port 12*b* is equipped with a swirl control valve 32 which is in either the open or closed portion. When the swirl control valve 32 is in the closed portion, the straight port 12*b* is closed and all of the inlet air flows into the engine cylinder through the helical port 12*a*. Accordingly, the inlet air flow forms a strong swirl in the engine cylinder, and thus a stable combustion of the lean air-fuel mixture can be obtained. Conversely, when the swirl control valve 32 is in the open position, the inlet air flows into the cylinder through both of the inlet ports 12*a*, 12*b*, whereby the volume of the inlet air is increased.

The swirl control valve 32 comprises a valve plate 32*a* connected to an actuator 38 via a lever 34 and a rod 36.

The actuator 38 comprises a diaphragm 40, and spring 41 biasing the diaphragm downward. When a negative pressure is introduced to the upper side of the diaphragm 40, the diaphragm 40 and the rod 36 are moved upward against the force of the spring 41 and the swirl control valve 32 is moved to the open position. Conversely, when the atmospheric pressure is introduced to the upper side of the diaphragm 40, the swirl control valve 32 is urged downward to the closed position, by the spring 41.

The chamber formed at the upper side of the diaphragm 40 is connected to the pressure port 22 a formed on the surge tank 22 via a timing control valve 42, a solenoid operated three-way valve 44, and a check valve 46. The timing control valve 42 includes an orifice 42*a* and a check valve 42*b* arranged in parallel to each other. The timing control valve 42 maintains the opening speed of the swirl control valve 32 at an appropriate level by controlling the speed of the introduction of the atmospheric air to the upper side of the diaphragm 40. The check valve 46 maintains the negative pressure on the upper side of the diaphragm 40 when the pressure in the surge tank 22 becomes higher.

The solenoid operated three way valve 44 comprises three ports 44*a*, 44*b* and 44*c*. When the solenoid is de-energized, the port 44*a* is communicated with the port 44*c*, and the upper side of the diaphragm 40 is open to the pressure port 22*a* of the surge tank 22. On the other hand, when the solenoid is energized, the port 44*a* is communicated to the port 44*b*, and the upper side of the diaphragm 40 is open to the atmosphere, through a filter 48 and the orifice 42*a* of the timing control valve 42.

An electronic control unit 50 is provided to control the swirl control valve 32 by energizing and de-energizing the solenoid of the three way valve 44. The electronic control unit 50 is constructed as a digital computer which comprises a ROM (read only memory) 52, a RAM (random access memory) 53, a CPU (central processing unit) 54, an input port 55 and an output port 56. The ROM 52, The RAM 33, the CPU 54, the input port 55 and the output port 56 are interconnected by a bidirectional bus 51.

The electronic control unit 50 also controls the amount of fuel injected by a fuel injector 26 and the ignition timing according to the inventor. Accordingly, the output port 56 of the electronic control unit 50 is connected to the fuel injector 26 and the solenoid operated three way valve 44, via a corresponding drive circuit 60 and 61, and to the distributor 30 via a ignition circuit 62. An absolute pressure sensor 72, which generates an output voltage proportional to the absolute pressure PM in the surge tank 22, is mounted on the surge tank 22, and the output voltage of the absolute pressure sensor 72 is input to the input port 55 via an AD convertor 64.

Crank angle sensors 74 and 76 are mounted on the distributor 30. The first crank angle sensor 74 detects a reference position of the crank shaft rotation and generates a pulse signal at, for example, each 720 degrees rotation of the crank shaft. The second crank angle sensor 76 detects the rotation angle of the crank shaft and generates a pulse signal at, for example, each 30 degrees rotation of the crank shaft.

The outputs of the crank angle sensors 74, 76 are input to the input port 55, and the engine speed NE is calculated from the pulse output by the crank angle sensor 76 to the CPU 54.

A throttle sensor 79 is mounted on the throttle valve 24 and generates an output voltage proportional to the degree of opening of the throttle valve 24. The output of the throttle sensor 79 is input to the input port 55 via an AD converter 65. A coolant temperature sensor 84, which generates an output voltage proportional to the cooling water temperature, is mounted on the engine. The output of the coolant temperature sensor 84 is input to the input port 55 via AD converter 66.

Figure 2:
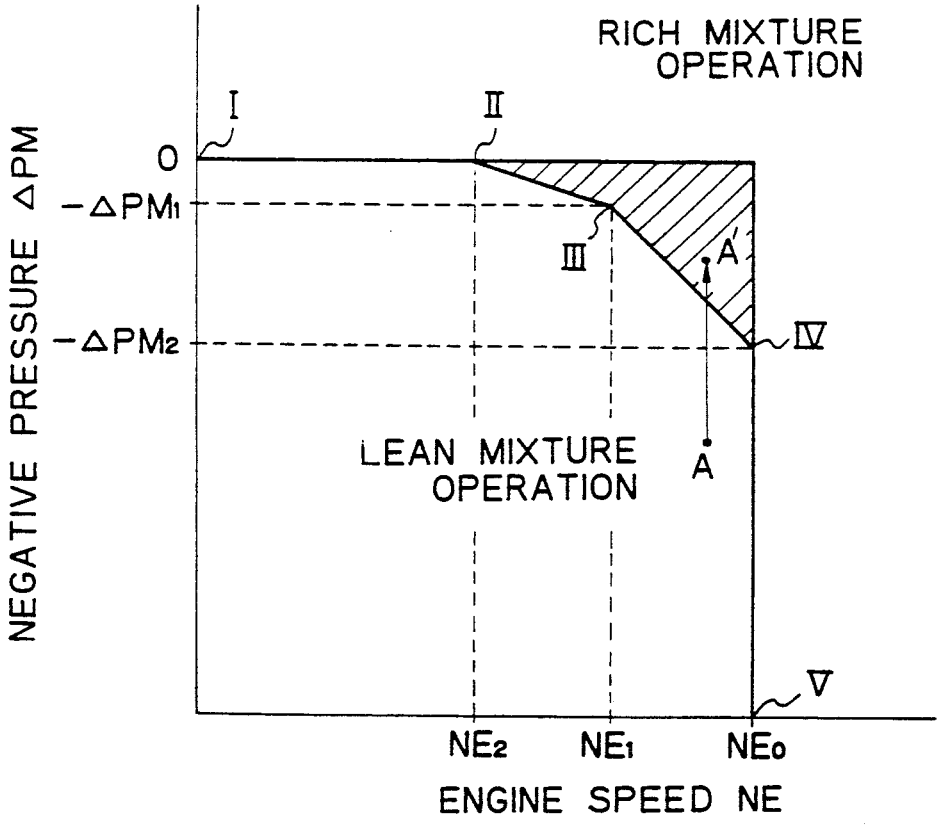
FIG. 2 is a diagram illustrating the relationship between the negative pressure in the inlet air surge tank and the engine speed.

FIG. 2 illustrates the relationship between the operation modes and the engine load. In the figure, ΔPM represents a negative pressure in the surge tank 22 (i.e., atmospheric pressure minus absolute pressure PM in the surge tank 22). The negative pressure in the surge tank has a close relationship with the engine load, and the ΔPM becomes low (i.e., absolute pressure in the surge tank PM becomes high) as the engine load becomes high. In this embodiment, the negative pressure ΔPM is used as a parameter representing the engine load.

According to the present invention, the engine is operated in the rich mixture operation mode when the engine load is higher than or equal to the set load value, and is operated in the lean mixture operation mode when the load is lower than the set load value.

In this embodiment, the set value of the engine load is represented by the negative pressure ΔPM in the form of four lines I-II, II-III, III-IV, IV-V as shown in FIG. 2. The setting value of ΔPM becomes higher as the engine speed approaches $NE_0$ (note that the vertical axis represents $-\Delta PM$, and lower points in the figure indicate higher ΔPM values). As shown in the figure, when the engine speed become higher than the value $NE_0$, the ΔPM setting value become very high, and accordingly, corresponds to a zero engine load. Therefore, when the engine speed exceeds $NE_0$, the operation mode of the engine is switched to the rich mixture operation mode regardless of the engine load (i.e., the negative pressure ΔPM in the surge tank).

In this embodiment, the line I-II is parallel to the horizontal axis and intersects the vertical axis at $\Delta PM=0$. $\Delta PM_1$, $\Delta PM_2$, and $NE_0-NE_2$, which define the points II-V, are as follows:

$\Delta PM_1=50$ mmHg, $\Delta PM_2=150$ mmHg, $NE_0=4000$ rpm, $NE_1=3800$ rpm, $NE_2=3600$ rpm.

As a result of the above setting of the operation mode, the operation mode is switched to the rich mixture operation by a smaller amount of depression of the accelerator pedal (see points A and A' in FIG. 2), and accordingly, a faster acceleration is obtained by a smaller amount of depression of the accelerator pedal, and thus any adverse affect on the drivability is lessened.

Figure 7:
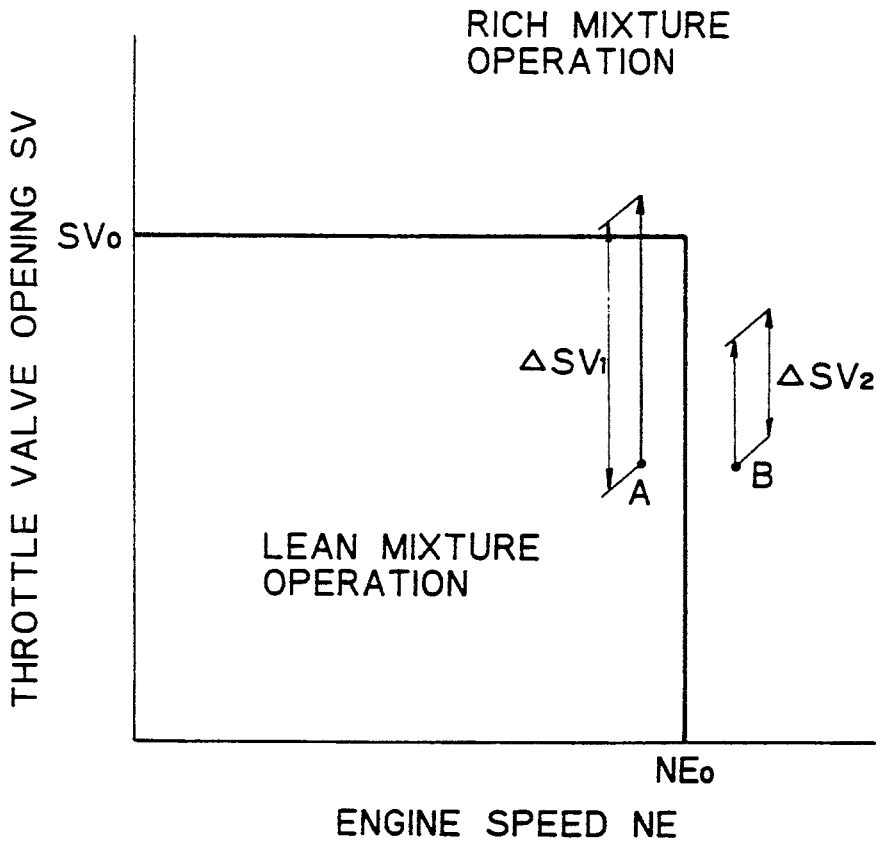

In this embodiment, the range of the lean mixture operation mode is narrower by the hatched area shown in FIG. 2, in comparison with the range described in FIG. 7, but since an acceleration is frequently required in this area, as explained above, the fuel economy is not affected even if the engine is operated completely in the rich mixture mode in this area. The speed $NE_0$ is set at the same value of the speed $NE_0$ in FIG. 7.

Figure 3:
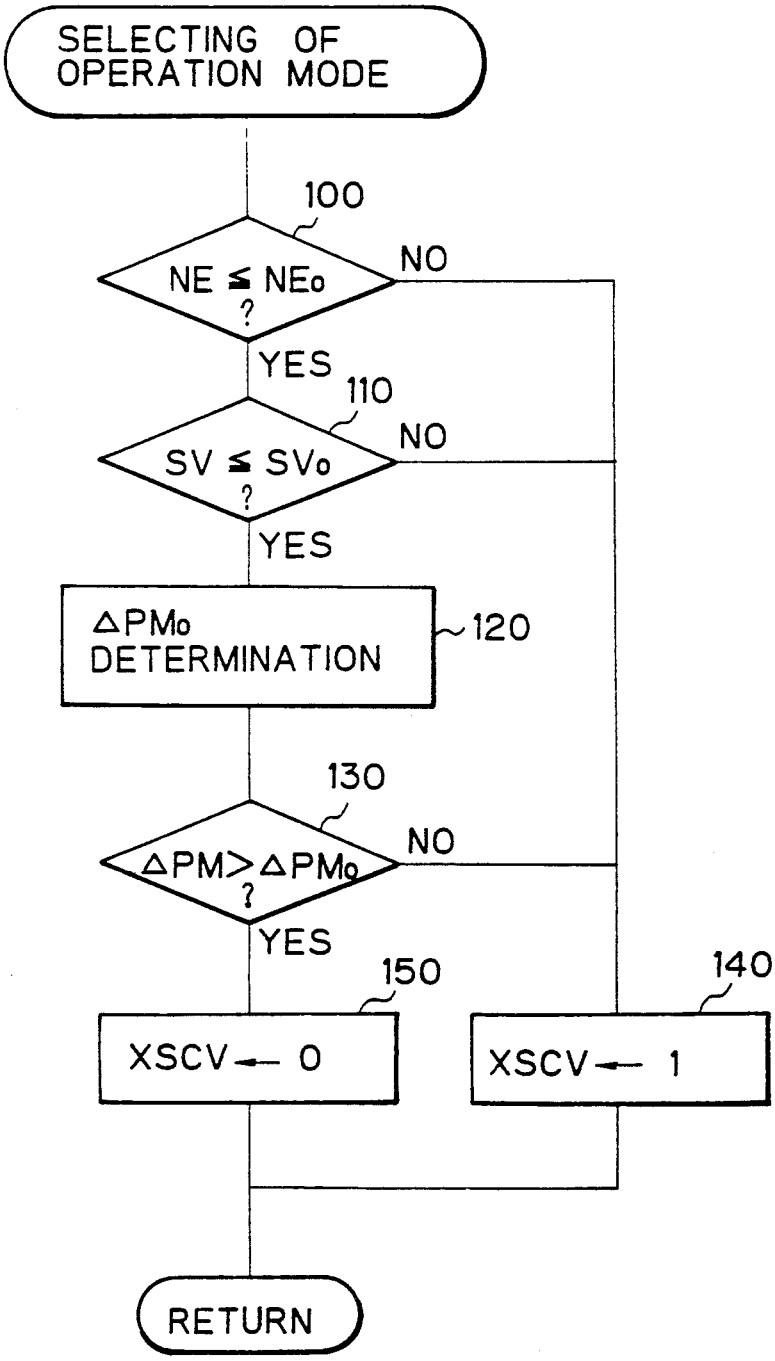
FIG. 3 is a flow chart of the routine for selecting the operation mode of the engine.

FIG. 3 illustrates the routine for selecting the operation mode of the engine. This routine is processed by the electronic control unit 50 by sequential interruptions at predetermined intervals (e.g., 32 mmsec).

Referring to FIG. 2, in step 100 it is determined whether the engine speed NE is lower than or equal to the predetermined value $NE_0$. If the engine speed NE is higher than $NE_0$, the routine proceeds to step 140 in which a flag XSCV is set. The flag XSCV determines the operation mode of the engine, and when the flag XSCV is set, the engine is switched to operate on a rich air-fuel mixture.

If the engine speed is lower than or equal to $NE_0$, the routine proceeds to step 110 in which it is determined whether the degree of opening of the throttle valve SV is smaller than or equal to a predetermined value $SV_0$. If SV is larger than $SV_0$, the routine proceeds to step 140 in which the flag XSCV is set. As shown in FIG. 2, in this embodiment, the ΔPM setting value is set at zero in the region where the engine speed is less than $NE_2$. Accordingly, even if the throttle valve is fully open, the rich mixture operation mode is not selected in this region unless ΔPM becomes zero. Therefore, if the degree of opening of the throttle valve is larger than the predetermined value $SV_0$ (e.g., $SV_0$ is about 80%) the engine is switched to the rich mixture operation mode even if ΔPM is not zero. The degree of opening of the throttle valve is input from the throttle sensor 79 at predetermined intervals. If SV is not larger than $SV_0$, the setting value $\Delta PM_0$ is determined in step 120. The value $\Delta PM_0$ is determined by the CPU 54, using the factors shown in FIG. 2, which are stored in the ROM 52 in the form of a numeric table. Then, in step 130, it is determined whether the negative pressure ΔPM in the surge tank is larger than $\Delta PM_0$ (i.e. $|\Delta PM|>\Delta PM_0|$). The negative pressure ΔPM is calculated by the CPU 54 as the difference between the atmospheric pressure $P_0$ and the absolute pressure PM in the surge tank 22. In this embodiment, the PM is detected by the pressure sensor 52. The atmospheric pressure $P_0$ is also determined by the pressure sensor 52, before each start up of the engine when the pressure in the surge tank is equal to the atmospheric pressure. The value of the atmospheric pressure is stored in the RAM 53 during the engine operation. By using the negative pressure ΔPM as the parameter of the engine load, the selection of the operation mode is not affected by the changes in altitude and resulting variations in the absolute pressure in the surge tank.

In step 150, if ΔPM is higher than $\Delta PM_0$, the flag XSCV is reset, and thus the engine is switched to lean mixture operation mode.

Figure 4:
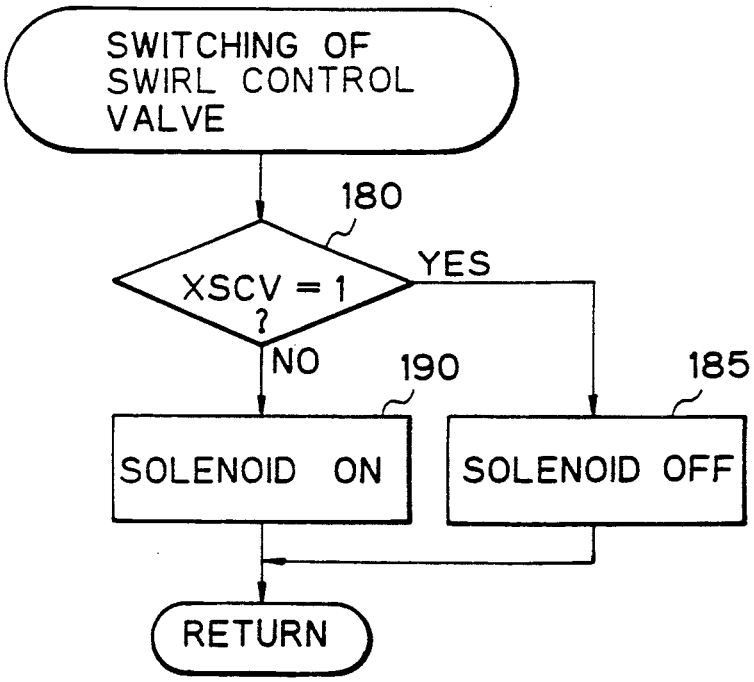
FIG. 4 is a flow chart of the routine for actuating the swirl control valve in accordance with the selected operation mode.

FIG. 4 illustrates the routine for switching the position of the swirl control valve according to the selected operation mode. This routine is processed by the electronic control unit 50 by sequential interruptions at predetermined intervals.

Referring to FIG. 4, in step 180 it is determined whether the flag XSCV is set. The flag XSCV represents the selected operation mode and is set or reset by the routine in FIG. 3.

When the flag XSCV is set in step 180 then in step 185 the solenoid of the three way valve 44 is de-energized. As explained above, when the solenoid is de-energized, the pressure port **22*a* of the surge tank 22 is in communication with the upper side of the diaphragm 40 of the actuator 38, via the check valve 42*b*, and therefore, the diaphragm 40 is moved upward against the force exerted by the spring 41. This movement of the diaphragm 40 causes the swirl control valve 32 to move to the closed position, and when the swirl control valve 32 is in the closed position, the negative pressure in the actuator 38 is maintained by the check valve 46, and thus the swirl control valve 32 is held in the closed position even when the pressure in the surge tank 22** becomes higher.

When the flag XSCV is reset, in step 190 the solenoid of the three way valve 44 is de-energized and the upper side of the diaphragm 40 of the actuator 38 is then open to the atmosphere through the filter 48 and the check valve 42*a* of the timing control valve 42. Accordingly, the diaphragm 40 is urged downward by the spring 41 and the swirl control valve 32 is moved to the open position. The opening speed of the swirl control valve 32 is appropriately controlled by the orifice 42*a*, and the closing speed thereof is maintained by the check valve 42*b*.

Figure 5:
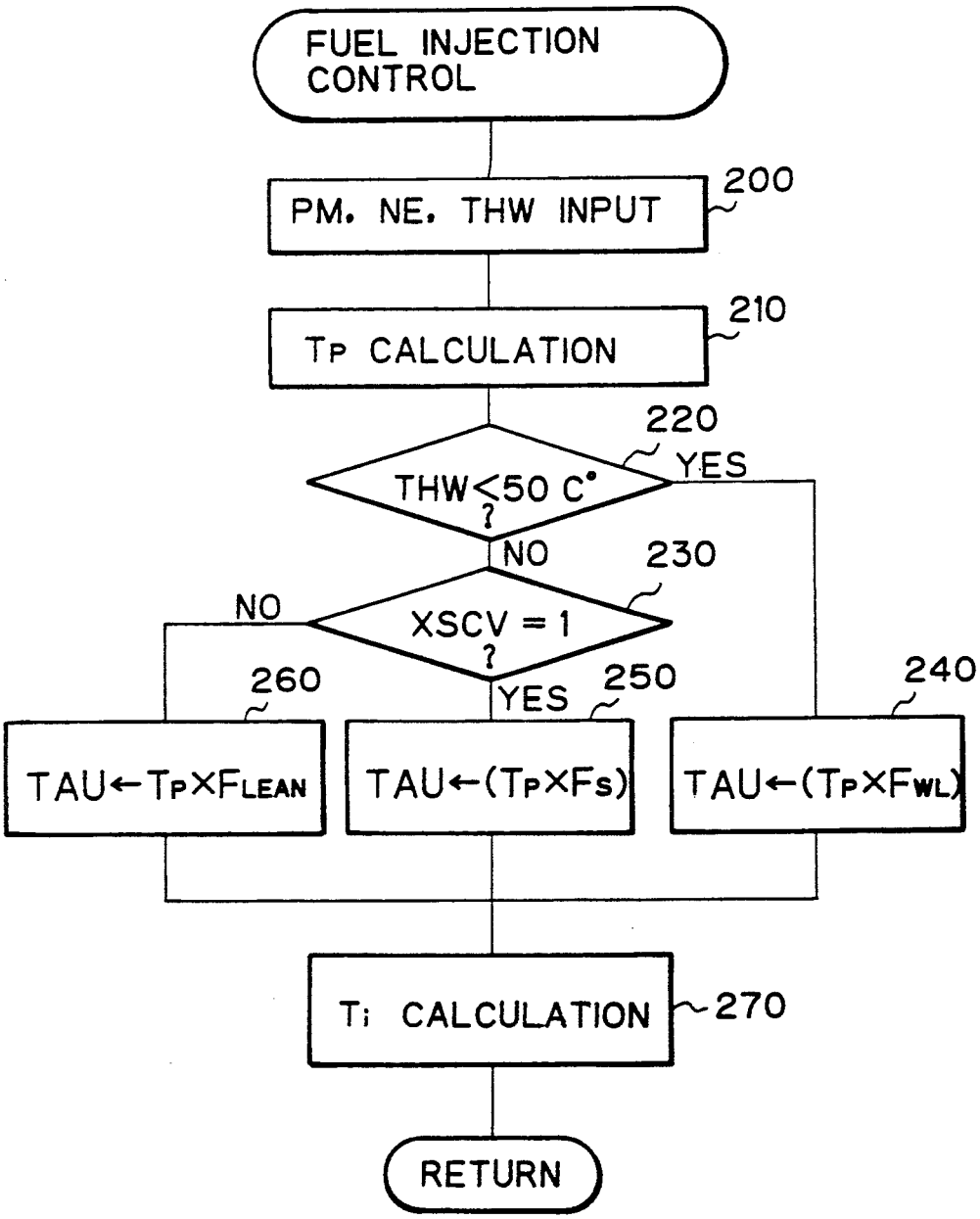
FIG. 5 is a flow chart of the routine for determining the amount of fuel to be injected in accordance with the selected operation mode.

FIG. 5 illustrates the routine for determining the amount of the fuel to be injected, to adjust the air-fuel ratio of the mixture in accordance with the operation mode selected by the routine in FIG. 3. This routine is processed immediately before the fuel is injected, when the crank angle detected by the sensors 74, 76 reaches a predetermined angle.

Referring to FIG. 5, in step 200, the intake air manifold pressure (the absolute pressure in the surge tank 22) PM, the engine speed NE, the cooling water temperature THW are read by the sensors 72, 76, 84, respectively, and in step 210, a standard amount of fuel injection $T_p$ is determined as a function of the manifold pressure PM and the engine speed NE. In this embodiment, the standard amount $T_p$ is stored in the ROM 52 of the electronic control unit 50, in the form of a numeric table. Note that if the standard amount $T_p$ is provided, the air-fuel ratio becomes stochiometric ratio. Then, in step 220, it is determined whether the cooling water temperature THW is lower than a predetermined temperature (for example, 50° C.). If THW is lower than the predetermined value, in step 240, a corrected amount of fuel injection TAU is determined by multiplying a correction factor FWL with the standard amount of fuel injection $T_p$. The correction factor FWL is determined as a function of the cooling water temperature, which is stored in the ROM 52 in the form of a numeric table. The purpose of the correction factor FWL is to make the air-fuel ratio of the mixture rich so that a stable combustion is obtained when the cooling water temperature is low. Then, in step 270, the fuel injection time $T_i$ is calculated on the basis of the determined TAU, and the fuel injector 26 is opened for the time $T_i$ so that the required amount of fuel TAU is injected.

When the cooling water temperature THW is higher than or equal to the predetermined value in step 220, then in step 230 it is determined whether the flag XSCV is set. When the flag XSCV is set, then the corrected amount of fuel injection TAU is decided in step 250 by multiplying a rich mixture correction factor $F_s$ with the standard amount of fuel injection $T_p$. The rich mixture correction factor $F_s$ is a constant value used to set the corrected amount of fuel injection so that the air-fuel ratio of the mixture becomes lower (richer) than or equal to stochiometric air-fuel ratio. Note that if the correction factor $F_s$ is equal to the value "1.0", the stochiometric air-fuel ratio is achieved, since the standard amount $T_p$ is provided. After the TAU is set in step 250, the fuel injection time $T_i$ is set in step 270. If the flag XSCV is reset in step 230, the corrected amount of fuel injection TAU is determined in step 260 by multiplying a lean mixture correction factor $F_{LEAN}$ with the standard amount of fuel injection $T_p$. The lean mixture correction factor $F_{LEAN}$ is a constant value used to set the corrected amount of fuel injection TAU so that the air-fuel ratio of the mixture becomes higher than the stoichiometric air-fuel ratio. Note that the lean mixture correction factor $F_{LEAN}$ is smaller than the value "1.0".

Figure 6:
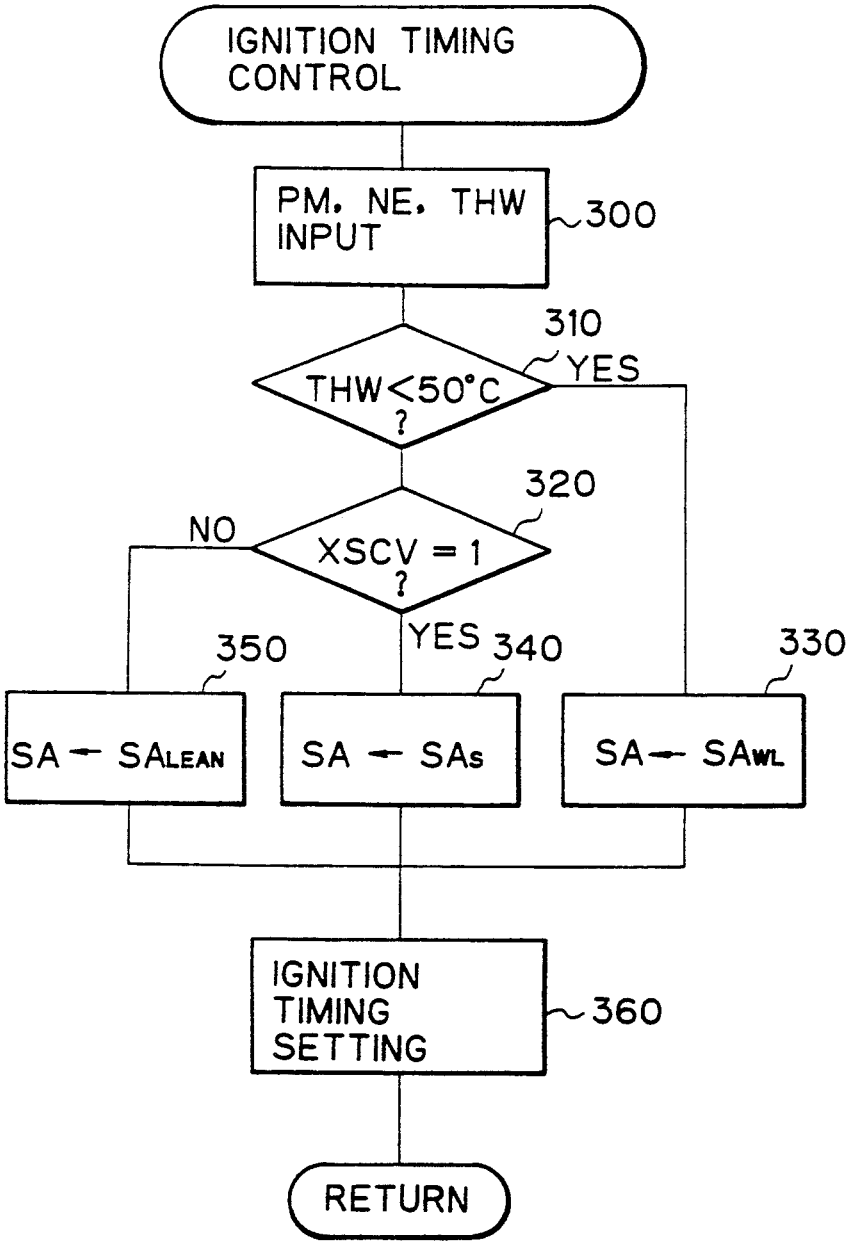
FIG. 6 is a flow chart of the routine for adjusting the ignition timing in accordance with the selected operation mode; and, FIG. 7 is a diagram illustrating the relationship between the operation modes and the engine load, in the prior art.

FIG. 6 illustrates the routine for selecting the ignition timing in accordance with the operation mode selected by the routine in FIG. 2. This routine is processed by the electronic control unit 50 as a part of the main routine for controlling the engine.

Referring to FIG. 6, steps 300, 310, 320, correspond to steps 200, 210, 220, in FIG. 5. When the cooling water temperature THW is lower than the predetermined value a cold condition ignition timing $SA_{WL}$ is selected as an ignition timing setting SA.

$SA_{WL}$ is a function of PM, NE and THW, which is stored in ROM 52 in the form of a numeric table, and provides an ignition timing suitable for the rich mixture established by the correction factor $F_{WL}$ in step 240 of FIG. 5.

Similarly, $SA_s$ (step 340) and $SA_{LEAN}$ (step 350) are selected as the ignition timing setting SA, in accordance with the setting of the flag XSCV.

$SA_S$ and $SA_{LEAN}$ are the functions of PM and NE, and provide an ignition timing suitable for the rich mixture established by step 250 and the lean mixture established by step 260 in FIG. 3 respectively. Since the air-fuel ratio of the mixture and the ignition timing, as well as the position of the swirl control valve, are switched in accordance with the operation mode selected by the routine in FIG. 3, a stable combustion can be obtained with both a rich and a lean air-fuel mixture.

According to the present invention, the engine is switched to a rich mixture operation when the set value of the engine load is reduced as the engine speed approaches a predetermined value. Therefore, a large acceleration can be obtained with a small amount of depression of the accelerator pedal, near the upper speed limit of the lean mixture mode operation range. Further, the worsening of the fuel consumption caused by the narrowed lean mixture operation range is kept to a minimum, since the upper limit speed of the lean mixture operation range can be set at the same value as in prior art. Note that it is clear that any parameters that represent the engine load, such as degree of the throttle valve, absolute pressure in the surge tank, and intake air amount per one revolution of the engine, can be utilized instead of the negative pressure ΔPM.

We claim:

1. An air-fuel ratio control device for an engine comprising:

means for detecting a load of the engine;

means for detecting a speed of the engine;

operation mode selecting means for selecting operation modes of said engine, said operation mode selecting means selecting a rich mixture operation mode in which said engine is operated on a rich air-fuel mixture having an air-fuel ratio lower than or equal to a stoichiometric ratio when the load of the engine is higher than a set load value, and said operation mode selecting means selecting a lean mixture operation mode in which said engine is operated on a lean air-fuel mixture having an air-fuel ratio higher than the stoichiometric ratio when said engine load is lower than or equal to said set load value;

air-fuel ratio setting means for adjusting the air-fuel ratio in accordance with said operation mode selected by said operation mode selecting means;

load value setting means for setting said set load value, said load value setting means setting said set load value in accordance with the engine speed so that said set load value is reduced as the engine speed is increased.

2. An air-fuel ratio control device according to claim 1, wherein said operation mode selecting means selects the rich mixture operation mode regardless of the engine load when the engine speed is higher than a predetermined set speed.

3. An air-fuel ratio control device according to claim 2, wherein said set load value is reduced linearly as the engine speed is increased.

4. An air-fuel ratio control device according to claim 3, wherein the relationship between said set load value and the engine speed is linear, but includes at least two regions in which the proportional factors between said set load and the engine speeds are different.

5. An air-fuel ratio control device according to claim 1, wherein said air-fuel ratio setting means comprises:

fuel injectors;

a fuel injection control means for adjusting an amount of fuel needed to obtain an air-fuel ratio in accordance with said operation mode selected by said operation mode selecting means; and an ignition timing control means for adjusting an ignition timing in accordance with said operation mode selected by said operation mode selecting means.

6. An air-fuel ratio control device according to claim 5, wherein said air-fuel ratio setting means further comprises means for generating an inlet air swirl within engine cylinders when said lean mixture operation mode is selected.

7. An air-fuel ratio control device according to claim 6, wherein said means for generating an inlet air swirl includes helical ports and straight ports of the engine cylinders for inlet air, and swirl control valves which those inlet air passages to said straight ports when said lean mixture operation mode is selected, so that inlet air flows into the engine cylinders only through said helical ports.

8. An air-fuel ratio control device according to claim 7, wherein said operation mode selecting means selects the rich mixture operation mode regardless of the engine load when the engine speed is higher than a predetermined set speed.

9. An air-fuel ratio control device according to claim 8, wherein said set load value is reduced linearly as the engine speed is increased.

10. An air-fuel ratio control device according to claim 9, wherein the relationship between said set load value and the engine speed is linear, but includes at least two regions in which the proportional factors between said set load and the engine speeds are different.

11. An air-fuel ratio control device according to claim 1, wherein said means for detecting a load of the engine detects an engine load by detecting a difference between an atmospheric pressure and a pressure in the intake air passage of the engine.

12. An air-fuel ratio control device according to claim 11, wherein said air-fuel ratio setting means comprises:

fuel injectors;

a fuel injection control means for adjusting an amount of fuel needed to obtain an air-fuel ratio in accordance with said operation mode selected by said operator mode selecting means; and an ignition timing control means for adjusting an ignition timing in accordance with said operation mode selected by said operation mode selecting means.

13. An air-fuel ratio control device according to claim 12, wherein said air-fuel ratio setting means further comprises means for generating an inlet air swirl within engine cylinders when said lean mixture operation mode is selected.

14. An air-fuel ratio control device according to claim 13, wherein said means for generating an inlet air swirl includes helical ports and straight port of the engine cylinders for inlet air, and swirl control valves which close inlet air passages to said straight port when said lean mixture operation mode is selected, so that inlet air flows into the engine cylinders only through said helical ports.

15. An air-fuel ratio control device according to claim 14, wherein said operation mode selecting means selects the rich mixture operation mode regardles of the engine load when the engine speed is higher than a predetermined set speed.

16. An air-fuel ratio control device according to claim 15, wherein said set load value is reduced linearly as the engine speed is increased.

17. An air-fuel ratio control device according to claim 16, wherein the relationship between said set load value and the engine speed is linear, but includes at least two regions in which the proportional factors between said set load and the engine speeds are different.

18. An air-fuel ratio control device for an engine comprising:

means for detecting a load of the engine;

means for detecting a speed of the engine;

means for selecting a set load value in accordance with the speed of the engine so that said selected set load value reduces as the speed of the engine increases;

means for determining whether said detected load of the engine is larger than said selected set load value; and means for providing an air-fuel mixture having an air-fuel ratio larger than stoichiometric air-fuel ratio when the detected load of the engine is smaller than said selected set load value.

19. An air-fuel ratio control device according to claim 18, wherein said load of the engine is a parameter relating to pressure in a intake passage of the engine, further comprising:

means for detecting degree of an throttle valve opening of said engine;

means for determining whether said degree of the throttle valve opening is larger than a predetermined throttle valve opening value;

means for providing air-fuel mixture having an air-fuel ratio equal to or smaller than stoichiometric air-fuel ratio when said detected degree of an throttle valve opening is larger than said predetermined throttle valve opening value.

* * * * *

UNITED STATES PATENT AND TRADEMARK OFFICE

CERTIFICATE OF CORRECTION

PATENT NO. : 5,146,885

DATED : September 15, 1992

INVENTOR(S) : Takao FUKUMA, et al.

It is certified that error appears in the above-identified patent and that said Letters Patent is hereby corrected as shown below:

ABSTRACT, line 3, change "set" to --sets--.

ABSTRACT, line 6, change "become" to --becomes--.

Column 4, line 17, change "22 a" to --22a--.

Column 4, line 54, change "a" to --an--.

Column 7, line 31, after "becomes" insert --a--.

Column 9, line 38, after "which" at the end of the line insert --close--.

Column 10, line 16, change "port" to --ports--.

Column 10, line 18, change "port" to --ports--.

Column 10, line 24, change "regardles" to --regardless--.

Column 10, line 52, change "a" to --an--.

UNITED STATES PATENT AND TRADEMARK OFFICE

CERTIFICATE OF CORRECTION

PATENT NO. : 5,146,885

DATED : September 15, 1992

INVENTOR(S) : Takao FUKUMA, et al.

It is certified that error appears in the above-identified patent and that said Letters Patent is hereby corrected as shown below:

Column 10, line 54, change "an" to --a--.

Column 10, line 59, between "providing" and "air-fuel" insert --an--.

Signed and Sealed this

Second Day of November, 1993

Bruce Lehman

*Attest:*

BRUCE LEHMAN

*Attesting Officer*

*Commissioner of Patents and Trademarks*